United States Patent [19]

Infusino

[11] 4,173,083

[45] Nov. 6, 1979

[54] ATHLETIC SHOE CONSTRUCTION

[75] Inventor: Ralph J. Infusino, Bartlett, Ill.

[73] Assignee: Riddell, Inc., Des Plaines, Ill.

[21] Appl. No.: 869,919

[22] Filed: Jan. 16, 1978

[51] Int. Cl.[2] ..... A43C 15/00; A43B 5/02

[52] U.S. Cl. ..... 36/59 R; 36/128

[58] Field of Search ..... 36/59 R, 59 C, 32 R, 36/114, 126, 128

[56] References Cited

U.S. PATENT DOCUMENTS

| | | | |
|---|---|---|---|
| 1,777,558 | 10/1930 | Freeman | 36/59 C |
| 2,677,905 | 5/1954 | Dye | 36/59 R |
| 2,678,507 | 5/1954 | Dye | 36/59 R |
| 3,581,414 | 6/1971 | Crawford | 36/59 R |
| 3,593,436 | 7/1971 | Vietas | 36/59 C |
| 3,619,916 | 11/1971 | Neri | 36/59 R |
| 3,818,617 | 6/1974 | Dassler et al. | 36/32 R |

FOREIGN PATENT DOCUMENTS

| | | | |
|---|---|---|---|
| 260726 | 3/1968 | Austria | 36/114 |
| 821611 | 11/1951 | Fed. Rep. of Germany | 36/128 |
| 2618655 | 11/1977 | Fed. Rep. of Germany | 36/59 R |
| 1423881 | 2/1976 | United Kingdom | 36/128 |

*Primary Examiner*—James Kee Chi

*Attorney, Agent, or Firm*—McDougall, Hersh & Scott

[57] ABSTRACT

An athletic shoe construction comprising a sole having cleats projecting therefrom. The improvement is provided in the toe area wherein the cleats comprise a plurality of spaced-apart ridges extending outwardly from and transversely across the sole. The forward surfaces of these ridges slant downwardly and rearwardly, and the more rearward of the ridges preferably extends outwardly a progressively greater distance from the sole than adjacent forwardly located ridges.

4 Claims, 6 Drawing Figures

ATHLETIC SHOE CONSTRUCTION

BACKGROUND OF THE INVENTION

This invention is directed to athletic shoes. It is well-known in the production of such shoes to provide cleats extending outwardly from the shoe soles for purposes of improving the grip of the toe relative to the playing surface. A variety of cleat designs have been developed, particularly since the advent of different types of synthetic playing surfaces. Thus, certain cleat designs are recognized to be more suitable for specific types of playing surfaces.

Some variations in cleat designs are proposed depending upon the sport involved and weather conditions. Thus, track shoes will have cleats quite different than football shoes, and different cleats will be used on football shoes depending upon whether wet or dry playing conditions are involved.

In spite of the variety of cleat designs available, problems are recognized in certain instances. Specifically, cleats have a tendency to "grab" relative to the playing surface, and this can be quite detrimental to performance. Particular reference is made to grabbing of cleats relative to the playing surface when an athlete is attempting to kick a ball. This is most apparent in the game of soccer where kicking is involved in a large percentage of the activity.

SUMMARY OF THE INVENTION

This invention generally involves the provision of an improved cleat structure in the toe area of an athletic shoe. The cleat structure is particularly designed to facilitate kicking functions in sports such as soccer.

The structure of this invention more particularly includes a plurality of ridges which extend outwardly of the sole of an athletic shoe in the toe area of the shoe. These ridges are spaced-apart, and they are positioned transversely across the sole with the forward surfaces of the ridges being in parallel relationship, and these surfaces are slanted rearwardly.

DETAILED DESCRIPTION OF THE INVENTION

The drawings illustrate a shoe 10 comprising an upper 12 and a sole 14. In the embodiment shown, the sole comprises a molded plastic member. A plurality of integrally formed cleats 16 of the truncated cone type are provided on the sole.

The pattern of the cleats 16 may vary, and the illustrated pattern comprises only an example. Similarly, there are many pattern designs for the cleats 16 which could be utilized depending upon the playing surface involved, weather conditions, etc.

Figure 5:
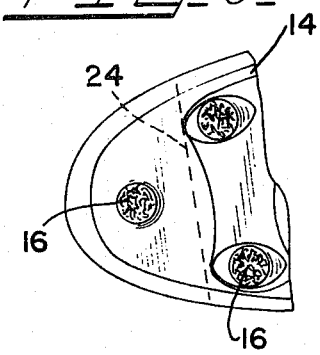
FIG. 5 is a fragmentary view of a shoe bottom illustrating the toe portion with a conventional cleat replacing the ridge design of this invention; and, FIG. 6 is a side view of the toe portion shown in FIG. 5.
Figure 6:
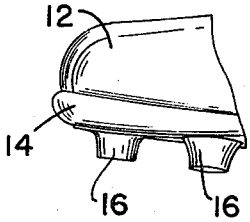

As shown in FIG. 5, the more typical athletic shoe construction will also include a cleat 16 in the toe area. Particularly when playing the game of soccer, this cleat in the toe area can disrupt the kicking function. Specifically, the cleat will at least occasionally "grab" on the playing surface preventing smooth foot movement into the ball. This may also adversely affect the stride of the player.

In accordance with this invention, the toe cleat 16 is replaced by the arrangement illustrated in FIGS. 1 through 4. This arrangement comprises ridges 18, 20 and 22. The ridges are parallel with each other, and they extend transversely across the sole of the shoe. The ridges are also characterized by forward surfaces which slant downwardly and rearwardly of the shoe. This effectively eliminates the "grabbing" tendency discussed above.

The ridges are also characterized by dimensions which improve their function. Specifically, the ridge 20 extends outwardly from the sole a greater distance than the ridge 18, and the ridge 22 extends progressively outwardly beyond the extent of the ridge 20. This arrangement has been found to provide the beneficial features described above while also providing a highly satisfactory structure from the standpoint of gripping characteristics. Thus, the ridge design is highly suitable from the standpoint of insuring that the wearer's shoe will maintain a good gripping relationship with the playing surface, particularly when the wearer is running with his weight concentrated toward the toe area of the shoe. Thus, the ridge design provides a highly satisfactory replacement for the single cleat typically utilized in this area of the shoe.

The location and dimensions of the ridges may vary to some degree in accordance with surface and weather conditions. Thus, it is well-known that longer cleats are preferred under some conditions and shorter cleats under other conditions, and such considerations will apply to the ridges illustrated.

It will also be understood that conventional materials of different types may be utilized for sole constructions employing the ridges. An integrally molded arrangement of the type illustrated is preferred. In this connection, a conventional mold may be modified by replacing the section of the mold used for forming the sole forwardly of the line 24 shown in FIG. 5. The replacement will comprise an insert designed for the formation of the ridges.

Figure 1:
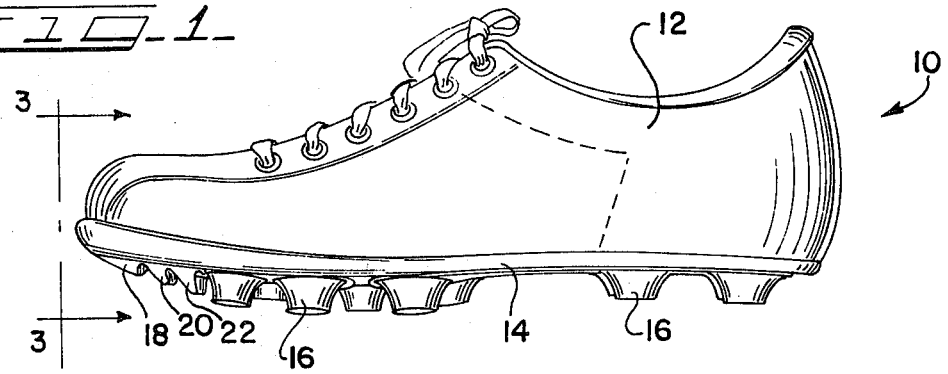
FIG. 1 is a side elevation of an athletic shoe characterized by the features of this invention.
Figure 2:
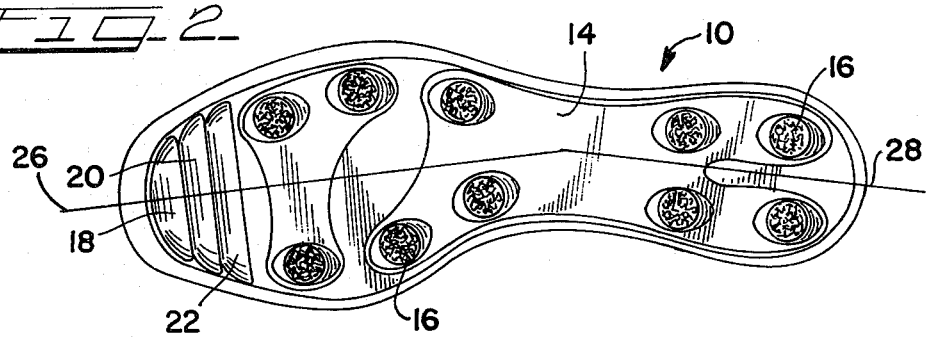
FIG. 2 is a bottom plan view of the shoe.
Figure 3:
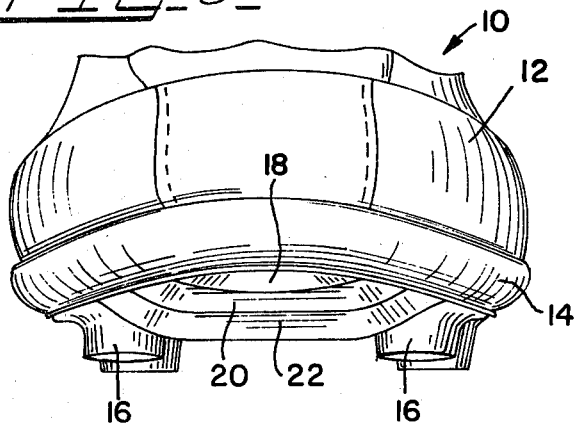
FIG. 3 is an enlarged, fragmentary view of the toe portion of the shoe taken about the line 3—3 of FIG. 1.
Figure 4:
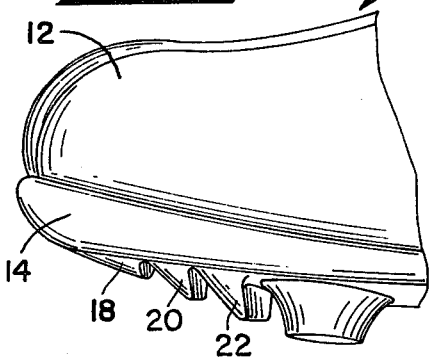
FIG. 4 is a side elevation of the toe portion shown in FIG. 3.

In typical arrangements, the ridges will extend perpendicular to the forward longitudinal axis of the shoe, this axis being represented by the line 26 in FIG. 2, the rear axis being represented by the line 28.

Dimensionally, the forwardmost ridge will extend outwardly at least about 1/16 inch from the sole surface, and the rearwardmost ridge a maximum of about ½ from the sole surface. From 2 to 5 ridges will typically be provided with the rearwardmost ridge being located a maximum of about 2 inches from the forwardmost toe portion of the shoe.

In a specific example of a soccer shoe, 3 ridges are provided with the forward ridge extending a maximum distance of about ⅛ inch from the sole, the second ridge a maximum distance of about ¼ inch from the sole, and the third ridge extending a maximum distance of about 5/16 inch from the sole. The rearwardmost portion of the third ridge was about $1\frac{5}{8}$ inch from the front of the toe.

It will be understood that various changes and modifications may be made in the constructions illustrated without departing from the spirit of this invention particularly as defined in the following claims.

That which is claimed is:

1. In a soccer shoe construction including a sole having cleats projecting therefrom, the improvement in the toe area of the sole comprising a plurality of spaced-apart ridges extending outwardly of the sole and transversely across the sole, said ridges being positioned substantially perpendicular to the longitudinal axis of the forward portion of the shoe, the forward surfaces of said ridges slanting downwardly and rearwardly relative to the sole, the more rearwardly located ridges extending outwardly a progressively greater distance than the more forwardly located ridges, and wherein a plurality of spaced-apart cleats are positioned on said sole rearwardly of said ridges.

2. A construction in accordance with claim 1 wherein said forward surfaces of each of the ridges extend from substantially adjacent the outer sole surface, the forwardmost ridge extending at least about 1/16th inch from the sole surface and the rearwardmost ridge extending a maximum of about $\frac{1}{2}$ inch from the sole surface.

3. A construction in accordance with claim 1 wherein three ridges are provided, the rearwardmost ridge being located a maximum of about two inches from the forwardmost toe portion of the shoe.

4. A construction in accordance with claim 3 wherein said sole including said ridges and cleats comprises an integrally molded, plastic structure.

* * * * *